US008038144B2

(12) United States Patent
Hara

(10) Patent No.: US 8,038,144 B2
(45) Date of Patent: Oct. 18, 2011

(54) IMAGE FORMING APPARATUS

(75) Inventor: Masashi Hara, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 3 days.

(21) Appl. No.: 12/656,078

(22) Filed: Jan. 15, 2010

(65) Prior Publication Data

US 2010/0207320 A1 Aug. 19, 2010

(30) Foreign Application Priority Data

Feb. 18, 2009 (JP) ..... P2009-035651

(51) Int. Cl.
*B65H 29/00* (2006.01)

(52) U.S. Cl. ..... 271/186; 271/3.14; 271/3.15; 271/3.17; 271/3.18; 271/301; 271/270

(58) Field of Classification Search ..... 271/3.14, 271/3.15, 3.17, 3.18, 184–186, 270
See application file for complete search history.

(56) References Cited

U.S. PATENT DOCUMENTS

| | | | | |
|---|---|---|---|---|
| 5,594,542 | A * | 1/1997 | Sugimoto et al. | 399/402 |
| 5,887,865 | A * | 3/1999 | Ishimaru | 271/4.1 |
| 6,402,133 | B1 * | 6/2002 | Miyake | 271/3.19 |
| 6,585,258 | B1 * | 7/2003 | Hirota et al. | 271/186 |
| 6,814,353 | B1 * | 11/2004 | Kakuta et al. | 271/186 |
| 7,318,585 | B2 * | 1/2008 | Soshiroda | 271/176 |
| 7,869,755 | B2 * | 1/2011 | Sano et al. | 399/367 |
| 2002/0008347 | A1 * | 1/2002 | Takida et al. | 271/3.14 |
| 2005/0251286 | A1 * | 11/2005 | Yasui | 700/230 |
| 2007/0040325 | A1 * | 2/2007 | Matsumoto et al. | 271/186 |
| 2010/0237557 | A1 * | 9/2010 | Hara et al. | 271/225 |

FOREIGN PATENT DOCUMENTS

| | | |
|---|---|---|
| JP | 2001-282050 | 10/2001 |
| JP | 2005-280897 | 10/2005 |

* cited by examiner

*Primary Examiner* — Kaitlin Joerger
*Assistant Examiner* — Prasad Gokhale
(74) *Attorney, Agent, or Firm* — The Nath Law Group; Jerald L. Meyer; Sungyeop Chung

(57) ABSTRACT

In an image forming apparatus, a sheet reversing mechanism is configured to take over and transfer, at a transfer speed Vr, a print sheet with an image already formed on one side being transferred at the transfer speed Vr from a first transfer mechanism, to stop the print sheet once, then to start transfer of the print sheet in an opposite direction, and to pass the print sheet to a second transfer mechanism at the transfer speed Vr. The first and second transfer mechanisms are located on upstream and downstream of a switchback reverse path for reversing print sheets respectively Upon lapse of a time T1 after detection of the print sheet by a print sheet detection unit, a transfer control unit drives the sheet reversing mechanism to start acceleration from a stopped state to the transfer speed Vr, the time T1 calculated based on the transfer speed Vr.

7 Claims, 11 Drawing Sheets

IMAGE FORMING APPARATUS

CROSS REFERENCE TO RELATED APPLICATION

This application is based upon and claims the benefit of priority from the prior Japanese Patent Application No. 2009-035651, filed on Feb. 18, 2009, the entire contents of which are incorporated herein by reference.

BACKGROUND OF THE INVENTION

1. Field of the Invention

The present invention relates to a printer, and more specifically to an image forming apparatus including a circulating transfer path having a sheet reversing mechanism.

2. Description of the Related Art

There has been known a double-sided printer which has a circulating transfer path including a sheet reversing mechanism and which reverses a sheet printed on one side to perform printing on the other side. There has recently been an increasing demand that a printer should have an improved productivity with faster printing speed. To achieve this, the printer is required to perform not only single-side printing but also double-side printing at a high productivity with faster printing speed.

The productivity of the printer depends mostly on a speed of image formation by a printing mechanism and a speed of transferring a print sheet by a transfer mechanism. Japanese Patent Application Publication No. 2005-280897 describes that productivity is improved by controlling, during double-side printing, a sheet transfer speed in circulating transfer according to a sheet size, independently of a sheet transfer speed in printing.

SUMMARY OF THE INVENTION

The image formation by the printing mechanism is the same in both single-side printing and double-side printing. Thus, image formation at a maximum speed of the printing mechanism, which is determined depending on printing conditions such as resolution, can be easily performed in both single-side printing and double-side printing. Here, the sheet transfer speed during printing is determined based on an image formation speed.

However, productivity of the printer depends not only on the image formation speed but also on the number of print sheets to be outputted per unit time. Since in single-side printing, the print sheets can be fed one after another, the sheet transfer speed by the transfer mechanism does not constrain the productivity. Therefore, the print sheets can be outputted by the maximum number of print sheets that the printing mechanism can output per unit time. On the other hand, in double-side printing, back printing is performed by circulatively transferring and reversing the print sheet having its front surface printed. Thus, a circulating transfer speed by the transfer mechanism affects the productivity of the printer. Specifically, an inappropriate circulating transfer speed causes a situation where no print sheet is transferred to the printing mechanism which is ready to perform printing. Thus, the productivity of the printing mechanism can not be fully used to output the print sheets.

Incidentally, in the sheet reversing mechanism, there has been widely used a method for providing a switchback path and revering the print sheet by temporarily stopping the print sheet on the switchback path and transferring the print sheet in an opposite direction. In this case, on the switchback path, such a control is repetitively made that the print sheet that is being transferred is decelerated and stopped, and then the print sheet is transferred in the reverse direction.

After transferring the print sheet in the reverse direction, the sheet reversing mechanism needs to prepare for transferring a next print sheet in a forward direction. When this preparation is delayed, sheet transfer is not smoothly performed and thus a proper circulating transfer speed cannot be achieved. If the transfer in the reverse direction is terminated earlier than needed in order to secure a preparation time, there arises a difference in speed from another sheet transfer mechanism concurrently transferring the same print sheet. Such a difference in speed may adversely affect the sheet transfer.

Accordingly, it is an object of the present invention to provide an image forming apparatus capable of properly performing forward-reverse control in a sheet reversing mechanism in order to accomplish output of print sheets at a productivity level achievable by a printing mechanism.

To achieve the object, a first aspect of the present invention is a image forming apparatus comprising: a circulating transfer path configured to form a path for circulatingly transferring print sheets, the path including a switchback reverse path for reversing print sheets; a plurality of transfer mechanisms provided on the circulating transfer path and configured to transfer print sheets; an image forming unit configured to perform image formation on print sheets being transferred on the circulating transfer path; a sheet reversing mechanism provided on the switchback reverse path, the sheet reversing mechanism configured to take over and transfer, at a transfer speed Vr, a print sheet with an image already formed on one side being transferred at the transfer speed Vr from a first transfer mechanism, to stop the print sheet once, then to start transfer of the print sheet in an opposite direction, and to pass the print sheet to a second transfer mechanism at the transfer speed Vr, the first transfer mechanism being located on an upstream of the switchback reverse path, the second transfer mechanism being located on a downstream of the switchback reverse path; a print sheet detection unit provided on the upstream of the switchback reverse path and configured to detect presence or absence of a print sheet; and a transfer control unit configured to control the sheet reversing mechanism, wherein upon lapse of a time T1 after detection of the print sheet by the print sheet detection unit, the transfer control unit drives the sheet reversing mechanism to start acceleration from a stopped state to the transfer speed Vr, the time T1 calculated based on the transfer speed Vr.

According to the first aspect, the transfer controlling means causes the sheet reversing mechanism to start acceleration from the stopped state to the transfer speed Vr upon completion of the time period T1 calculated based on the transfer speed Vr. Therefore, it is possible to ensure a preparation period for the sheet reversing mechanism to take over the print sheet in accordance with the transfer speed Vr.

The time T1 may be calculated shorter, as the transfer speed Vr becomes greater.

The image forming apparatus may further comprise a registration transfer mechanism provided on the circulating transfer path, the registration transfer mechanism configured to define a reference position of print sheets to be transferred to the image forming unit. And the transfer control unit may change a reference for a timing at which the sheet reversing mechanism starts deceleration while transferring the print sheet to the downstream of the switchback reverse path, depending on a relation between a length in a transfer direction of the print sheet and a distance between the sheet reversing mechanism and the registration transfer mechanism on the circulating transfer path.

According to this configuration, it is also possible to prevent the sheet reversing mechanism from being different in speed from another sheet transfer mechanism concurrently transferring the same print sheet.

The transfer control unit may, upon the length in the transfer direction of the print sheet being shorter than the distance between the sheet reversing mechanism and the registration transfer mechanism on the circulating transfer path, start deceleration of the sheet reversing mechanism at a time point when transfer of the print sheet to the downstream of the switchback reverse path is completed by the sheet reversing mechanism, and upon the length in the transfer direction of the print sheet being equal to or longer than the distance between the sheet reversing mechanism and the registration transfer mechanism on the circulating transfer path, start deceleration of the sheet reversing mechanism so as to stop the print sheet at the registration transfer mechanism.

The transfer control unit may, upon a sum of the length in the transfer direction of the print sheet and a distance in which the print sheet is transferred before being stopped at the registration transfer mechanism after start of deceleration being shorter than the distance between the sheet reversing mechanism and the registration transfer mechanism on the circulating transfer path, start deceleration of the sheet reversing mechanism at a time point when transfer of the print sheet to the downstream of the switchback reverse path is completed by the sheet reversing mechanism, and upon the sum of the length in the transfer direction of the print sheet and the distance in which the print sheet is transferred before being stopped at the registration transfer mechanism after start of deceleration being equal to or longer than the distance between the sheet reversing mechanism and the registration transfer mechanism on the circulating transfer path, start deceleration of the sheet reversing mechanism so as to stop the print sheet at the registration transfer mechanism.

The sheet reversing mechanism may include a switchback roller configured to transfer the print sheet being transferred from the upstream of the switchback reverse path and to transfer the print sheet to the downstream of the switchback reverse path, the registration transfer mechanism may include a registration roller configured to transfer the print sheet to the image forming unit, the transfer control unit may, upon the length in the transfer direction of the print sheet being shorter than a distance between the switchback roller and the registration roller on the circulating transfer path, start deceleration of the switchback roller at a time point when the print sheet is detached from the switchback roller while being transferred to the downstream of the switchback reverse path, and upon the length in the transfer direction of the print sheet being equal to or longer than the distance between the switchback roller and the registration roller on the circulating transfer path, start deceleration of the switchback roller so as to stop the print sheet at the registration roller.

The sheet reversing mechanism may include a switchback roller configured to transfer the print sheet being transferred from the upstream of the switchback reverse path and to transfer the print sheet to the downstream of the switchback reverse path, the registration transfer mechanism may include a registration roller configured to transfer the print sheet to the image forming unit, the transfer control unit may, upon a sum of the length in the transfer direction of the print sheet and a distance in which the print sheet is transferred before being stopped at the registration transfer mechanism after start of deceleration being shorter than a distance between the switchback roller and the registration roller on the circulating transfer path, start deceleration of the switchback roller at a time point when the print sheet is detached from the switchback roller while being transferred to the downstream of the switchback reverse path, and upon the sum of the length in the transfer direction of the print sheet and the distance in which the print sheet is transferred before being stopped at the registration transfer mechanism after start of deceleration being equal to or longer than the distance between the switchback roller and the registration roller on the circulating transfer path, start deceleration of the switchback roller so as to stop the print sheet at the registration roller.

The image forming unit may perform image formation on print sheets each having a length Ly in a transfer direction while employing a sheet interval Lg and a transfer speed Vg at a time of printing, and the transfer speed Vr may be set such that the print sheet is transferred circulatingly from the registration transfer mechanism to the same registration transfer mechanism within a time period of $N\times(Ly+Lg)/Vg$, wherein N is a circulating number to define a printing order for both side printing.

As described above, according to these configurations, it is possible to properly perform forward-reverse control in a sheet reversing mechanism in order to accomplish output of print sheets at a productivity level achievable by a printing mechanism.

DETAILED DESCRIPTION OF THE EMBODIMENT

Figure 1:
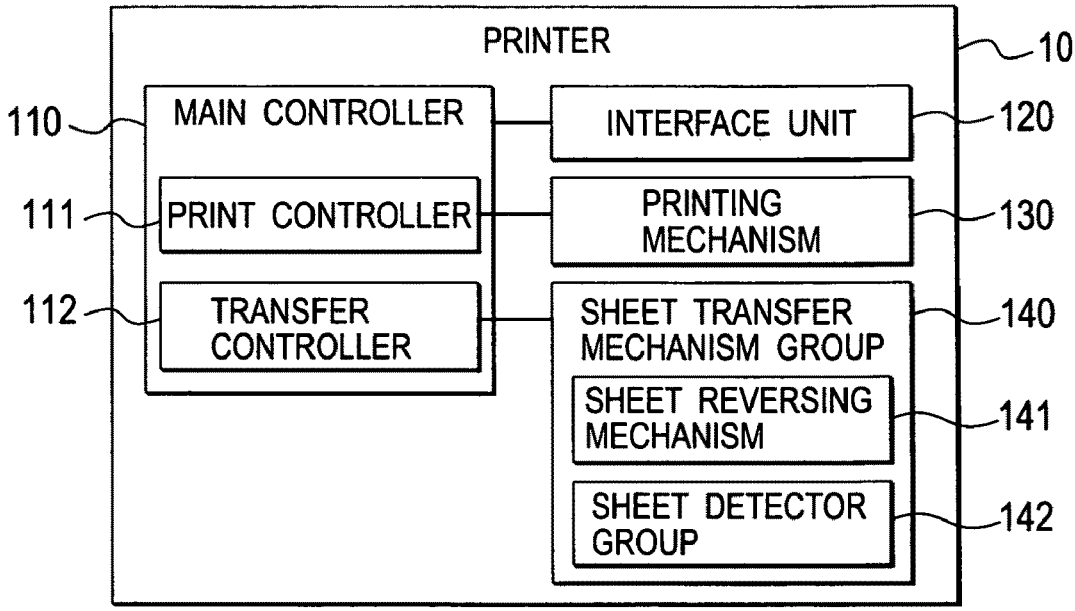
FIG. 1 is a block diagram showing a main functional configuration of a printer according to an embodiment of the present invention.

With reference to the drawings, an embodiment of the present invention will be described in detail. FIG. 1 is a block diagram showing a main functional configuration of a printer 10 according to an embodiment of the present invention. As shown in FIG. 1, the printer 10 includes a main controller 110, an interface unit 120, a printing mechanism 130 and a sheet transfer mechanism group 140.

The main controller 110 consists of a CPU, a memory, an image processing device and the like, and performs control of various kinds of processing in the printer 10 by operating the CPU according to programs stored in the memory, and by operating in other ways. In this embodiment, the main controller 110 includes a print controller 111 configured to control the printing mechanism 130 and a transfer controller 112 configured to control the sheet transfer mechanism group 140.

The interface unit 120 receives print data from an unillustrated computer network connected thereto and performs processing for accepting various settings from a user.

The printing mechanism 130 is a mechanism configured to perform print processing on a print sheet. In this embodiment, an ink jet printing mechanism is used, which is configured to perform printing line by line. The ink jet printing mechanism includes multiple line print heads each having a nozzle formed therein, and performs printing by ejecting black or color ink from each of the print heads. However, the present invention is not limited to the ink jet method but can be applied to printers using other printing methods. For example, the present invention may be applied to a serial ink jet printer, a laser printer, and the like.

The sheet transfer mechanism group 140 is the mechanism group which is configured to perform feeding, transferring, discharging, and the like of print sheets, and which includes rollers provided along a transfer path, transfer belts, motors for driving the rollers and the transfer belts, and the like. In this embodiment, the printer 10 includes a sheet reversing mechanism 141 configured to reverse a print sheet to perform both side printing, a switchback reverse path provided on the sheet reversing mechanism 141 for allowing the print sheet to pass through when reversing the sheet, and a sheet detector group 142 for detecting presence or absence of the sheet transferred on the transfer path.

Figure 2:
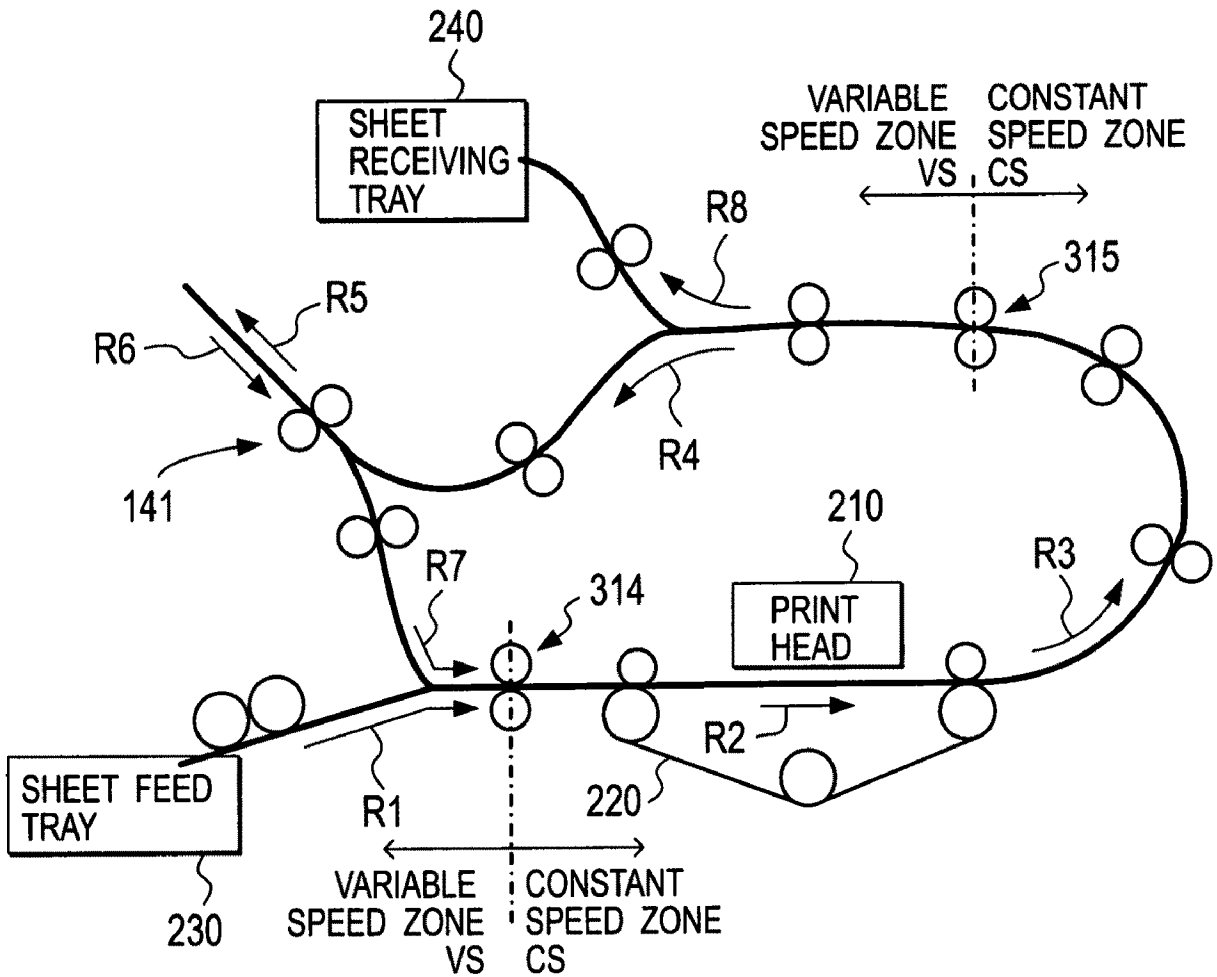
FIG. 2 is a diagram schematically showing a sheet transfer path in the printer according to the embodiment of the present invention.

FIG. 2 is a diagram schematically showing a sheet transfer path in the printer 10. As shown in FIG. 2, a print sheet is fed from a sheet feed tray 230, an image is formed thereon by a print head 210, and then the sheet is discharged onto a sheet receiving tray 240. The sheet transfer path forms a circulating path including the sheet reversing mechanism 141 so as to enable double-side printing. On the upstream side of the print head 210, registration rollers 314 for correcting inclination of the print sheet and adjusting timing are provided.

When the printer 10 performs double-side printing, the print sheet fed from the sheet feed tray 230 is transferred in an arrow R1 direction and then temporarily stopped for the inclination correction and the timing adjustment by the registration roller 314. Thereafter, the registration rollers 314 transfer the print sheet onto a transfer belt 220 provided so as to face the print head 210.

An image is formed line by line on a surface of the print sheet by the print head 210 while the print sheet, sticking to the transfer belt 220, is being transferred in an arrow R2 direction. A transfer speed in this event is determined according to image formation capability of the print head 210 and printing conditions such as resolution of an image to be formed. In the following description, a sheet transfer speed in image formation is assumed to be Vg.

Subsequently, the print sheet is transferred in an arrow R3 direction along the transfer path and further transferred by rollers such as upper-side transfer rollers 315. The print sheet having its front surface printed is guided in an arrow R4 direction without being discharged onto the sheet receiving tray 240. Then, the print sheet is drawn in an arrow R5 direction into the sheet reversing mechanism 141, and is stopped temporarily. Here, the arrow R5 direction is assumed to be a forward direction.

After being temporarily stopped, the print sheet is transferred in an arrow R6 direction by the sheet reversing mechanism 141 and thus reversed with respect to the print head 210. Note that the arrow R6 direction is assumed to be a reverse direction. Thereafter, the print sheet is transferred in an arrow R7 direction and then stopped for inclination correction and timing adjustment by the registration rollers 314. Subsequently, the print sheet is transferred again by the registration rollers 314 onto the transfer belt 220 provided so as to face the print head 210.

An image is formed on a back surface of the print sheet by the print head 210 while the print sheet is transferred in the arrow R2 direction at the speed Vg by the transfer belt 220 with the printed front surface facing down. Thereafter, the print sheet is transferred in the arrow R3 direction along the transfer path and further transferred by rollers such as the upper-side transfer rollers 315. The print sheet printed on both sides thereof is transferred in an arrow R8 direction and then discharged onto the sheet receiving tray 240.

As described above, in a section of the path from the registration rollers 314 to the upper-side transfer rollers 315, the print sheet is transferred at the constant transfer speed Vg which is required in consideration of the image formation capability, printing conditions and the like. This is because the print sheet needs to be transferred at a constant speed during the image formation. This section will be hereinafter referred to as a constant speed zone CS. On the other hand, a section of the path from the upper-side transfer rollers 315 to the registration rollers 314 is a section where the print sheet does not need to be transferred at the constant transfer speed Vg. This section will be hereinafter referred to as a variable speed zone VS. In the variable speed zone VS, the print sheet is basically transferred at a constant speed Vr higher than the transfer speed Vg, except that the print sheet is decelerated, stopped and accelerated by the sheet reversing mechanism 141 and decelerated to be stopped at the registration rollers 314.

Figure 3:
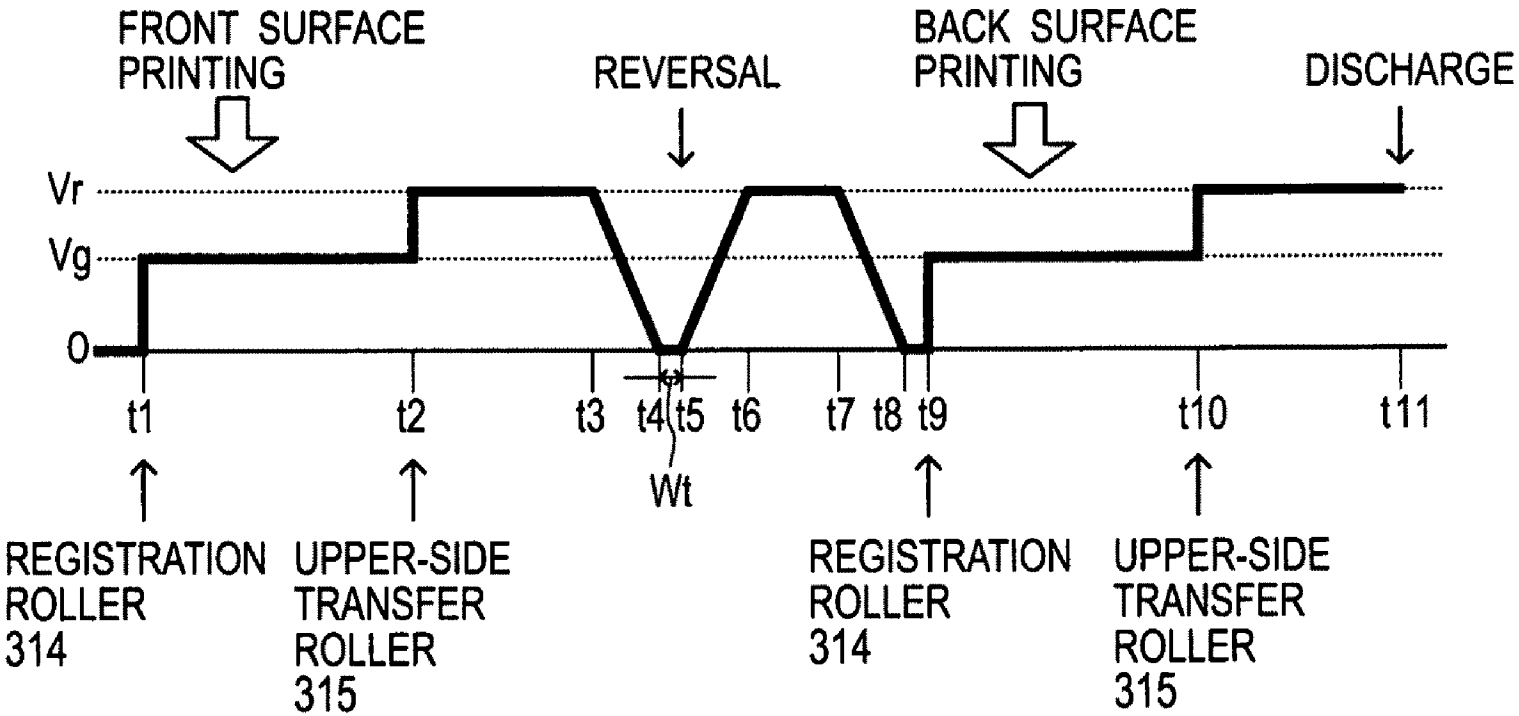
FIG. 3 is a chart showing speed transitions of a print sheet during double-side printing.

Accordingly, the print sheet undergoes speed transitions as shown in FIG. 3. Here, in FIG. 3, a horizontal axis represents time and a vertical axis represents a transfer speed. Specifically, the print sheet transferred at the constant transfer speed Vg from the registration rollers 314 at a time point t1 is subjected to front surface printing and then transferred at the constant circulating transfer speed Vr when reaching the upper-side transfer rollers 315 at a time point t2. The print sheet is decelerated from a time point t3 to reach a speed 0 at a time point t4. Acceleration in this event is $|\alpha|$. Thereafter, during a time period Wt between the time point t4 and a time point t5, the print sheet is temporarily stopped for reversal. Subsequently, the print sheet is accelerated to the transfer speed Vr at the acceleration $|\alpha|$ from the time point t5 to a time point t6 and then transferred at the constant transfer speed Vr until a time point t7. The print sheet is decelerated at the acceleration $|\alpha|$ from the time point t7 to be stopped at the registration rollers 314 and then returned to and temporarily stopped at the registration rollers 314 at a time point t8. Thereafter, the print sheet transferred at the constant transfer speed Vg from the registration rollers 314 at a time point t9 is subjected to back printing and then transferred at the transfer speed Vr when reaching the upper-side transfer rollers 315 at a time point t10. The print sheet is then discharged at a time point t11.

In this embodiment, the printer 10 is configured to be able to continuously perform printing at predetermined time intervals by feeding a next print sheet before discharging a preceding print sheet, not by feeding a certain print sheet and then feeding a next print sheet after the certain print sheet is printed and discharged. Thus, in continuous printing of multiple sheets, multiple print sheets lie on the transfer path in the printer 10. Here, the number of print sheets to be circulatively transferred along the transfer path is set to be a circulating number N. Note, however, that the circulating number N does not necessarily define the number of sheets simultaneously lying on the transfer path, but defines the order of printing of the front and back surfaces in a double-side printing schedule, which will be described later. For example, in the case where the circulating number is N, a front surface of a sheet A is printed and then a back surface of the sheet A is printed after the elapse of a period of time required for transferring other N−1 sheets.

Figure 4:
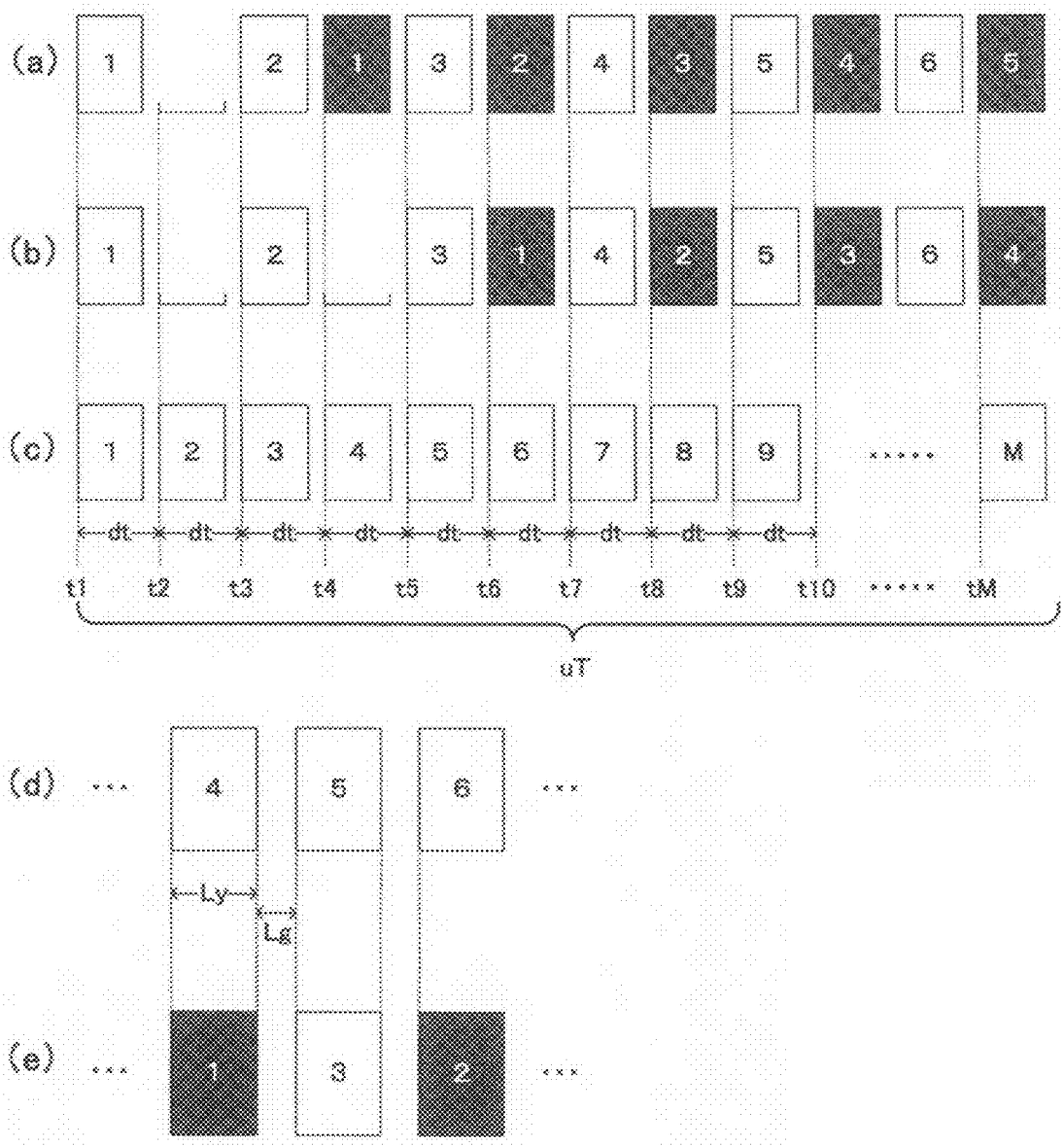
FIGS. 4(*a*) to 4(*e*) are diagrams for explaining a printing schedule.

Next, setting of the speed Vr in the variable speed zone VS will be described. Speed control in the variable speed zone VS is set in accordance with a printing schedule for double-side printing. Thus, the printing schedule will be first described. As described above, before discharging a preceding print sheet, the printer 10 is able to feed a next print sheet. By setting such a printing order of a case where multiple print sheets can be circulated that a front surface of a newly fed print sheet and a back surface of a circulatively transferred print sheet are alternately printed, productivity is improved by (Japanese Patent Application Publication No. 2001-282050, Paragraphs [0070] to [0072] and the like). For example, in the case of N=3, in other words, when three print sheets are circulated, a front surface of a first sheet is printed, a front surface of a second sheet is printed after an idle print time for one sheet, and then a back surface of the circulatively transferred first sheet is printed, as shown in FIG. 4(*a*). Thereafter, a front surface of a third sheet is printed and then a back surface of the circulatively transferred second sheet is printed. After that, a front surface of each newly fed print sheet and a back surface of each circulatively transferred print sheet are alternately printed in the similar manner. However, when feeding of new print sheets is completed at the end of printing, back printing of the circulatively transferred print sheets is performed twice in a row with an idle print time for one sheet interposed between the two back printing operations, and then the printing is finished. Note that, in FIGS. 4(*a*) to 4(*e*), front surface printing of a Kth sheet is indicated by a black K on a white background and back printing of the Kth sheet is indicated by a white K on a black background.

In the case of N=5, in other words, when five print sheets are circulated, a front surface of a first sheet is printed, a front surface of a second sheet is printed after an idle print time for one sheet, a front surface of a third sheet is further printed after an idle print time for one sheet, and then a back surface of the circulatively transferred first sheet is printed, as shown in FIG. 4(*b*). Thereafter, a front surface of a fourth sheet is printed and then a back surface of the circulatively transferred second sheet is printed. After that, a front surface of each newly fed print sheet and a back surface of each circulatively transferred print sheet are alternately printed in the similar manner. However, when feeding of new print sheets is completed at the end of printing, back printing of the circulatively transferred print sheets is performed three times in a row with idle print times each for one sheet respectively interposed between the first and the second back printing operation and between the second and the third back printing operation, and then the printing is finished.

It is assumed that the printer 10 can perform single-side printing for M sheets, for example, within a predetermined time uT as shown in FIG. 4(*c*). In this case, a time period between start of printing of a first sheet and start of printing of a second sheet is assumed to be dt. In the single-side printing, since print sheets can be fed one after another, the printer 10 can perform printing easily with the maximum productivity of the printing mechanism thereof. Specifically, the printer 10 only has to transfer the print sheets at such a printing speed and at sheet intervals, at which the printing mechanism can perform printing, such that required printing quality and the like can be maintained. Here, as shown in FIG. 4(*d*), a distance between two sheets during the single-side printing is assumed to be Lg. Since a length of the print sheet in the transfer direction is Ly, a distance of each print sheet including the distance between two sheets is Ly+Lg.

As shown in FIG. 4(*c*), the printer 10 has the productivity of the print time dt per sheet during the single-side printing. If double-side printing can be performed with the equivalent productivity as that described above, in other words, with the print time dt for one side, this means that double-side printing is performed with the maximum productivity of the printer 10. However, at the start and end of the double-side printing, there inevitably arise a period during which front surface printing is consecutively performed and a period during which back surface printing is consecutively performed, each period having the idle print time dt for one print sheet interposed therein. Thus, an actual target for realizing the maximum productivity of the printer 10 is a period during which face printing and back printing are alternately performed.

In order to realize the productivity, the print sheets may be circulated within a time period 3×dt when N=3, because the first print sheet front surface printing of which is started at t1, for example, is circulated to have back printing thereof started at t4, as shown in FIG. 4(*a*). Meanwhile, the print sheets may be circulated within a time period 5×dt when N=5, because the first print sheet front surface printing of which is started at t1 is circulated to have back printing thereof started at t6, as shown in FIG. 4(*b*). Specifically, when the number of sheets to be circulated is N, the print sheets may be circulated within a time period N×dt.

The print time dt is obtained by dividing the sum of the widths Ly of the print sheet and the sheet intervals by the sheet transfer speed. Here, the sheet transfer speed in printing is equal to Vg in both double-side printing and single-side printing. Thus, to perform the double-side printing with the equivalent productivity per side as that in the single-side printing, the sheet interval in the double-side printing is required to be equal to the sheet interval Lg in the single-side printing, as shown in FIG. 4(*e*). This means that, to perform the double-side printing with the equivalent productivity per side as that in the single-side printing, the circulating transfer speed Vr may be set so as to allow the print sheet to be circulated within the time N×(Ly+Lg)/Vg.

Figure 5:
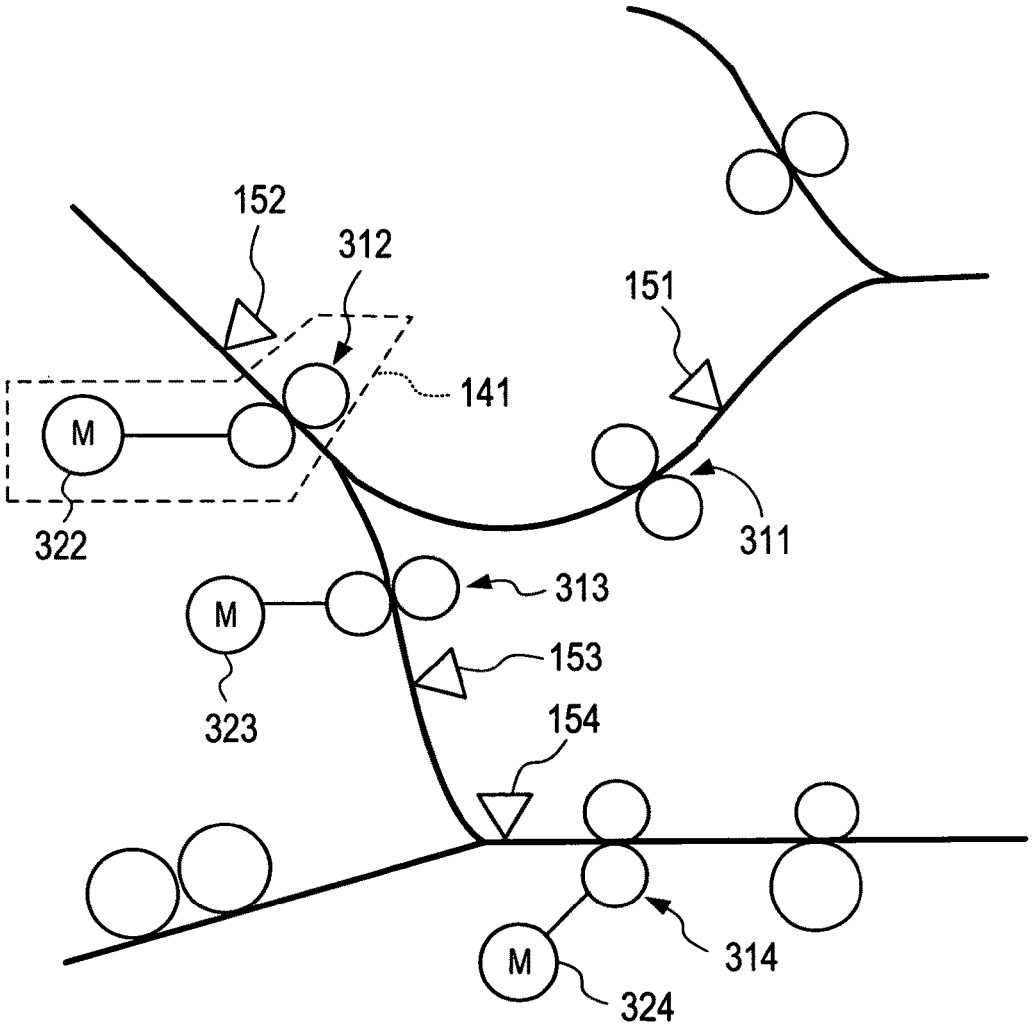
FIG. 5 is a diagram schematically showing details of a sheet transfer mechanism group around a sheet reversing mechanism.

Next, description will be given of the control of the sheet reversing mechanism 141 in this embodiment. FIG. 5 is a view schematically showing details of the sheet transfer mechanism 140 focused on the sheet reversing mechanism 141. As shown in FIG. 5, the sheet reversing mechanism 141 includes a switchback roller 312 and a switchback motor 322 serving as a driving force of the switchback roller 312. An upper-side transfer exit roller 311 is disposed on an upstream side of the switchback roller 312 and an upper-side transfer exit sensor 151 configured to detect presence or absence of a print sheet is disposed on an upstream side of the upper-side transfer exit roller 311. A switchback sensor 152 is disposed on a forward side of the switchback roller 312.

A sheet refeed roller 313 for guiding a reversed print sheet again to the registration roller 314 is disposed on a downstream side of the switchback roller 312. The sheet refeed roller 313 is driven by a sheet refeed motor 323. A sheet refeed sensor 153 is disposed on a downstream side of the sheet refeed roller 313. The registration roller 314 is driven by a registration motor 324 and a registration sensor 154 is disposed on an upstream side of the registration roller 314. Each of the sensors constitutes the sheet detector group 142 and outputs an on signal upon detection of passage of a sheet.

The switchback motor 322 and the sheet refeed motor 323 can be formed by use of stepping motors, for example, and can control transfer distances of the print sheet by adjusting pulse numbers to be applied thereto. Nevertheless, it is also possible to use DC motors or the like. In this case, transfer distances of the print sheet can be detected by providing encoders, for example.

Figure 6A:
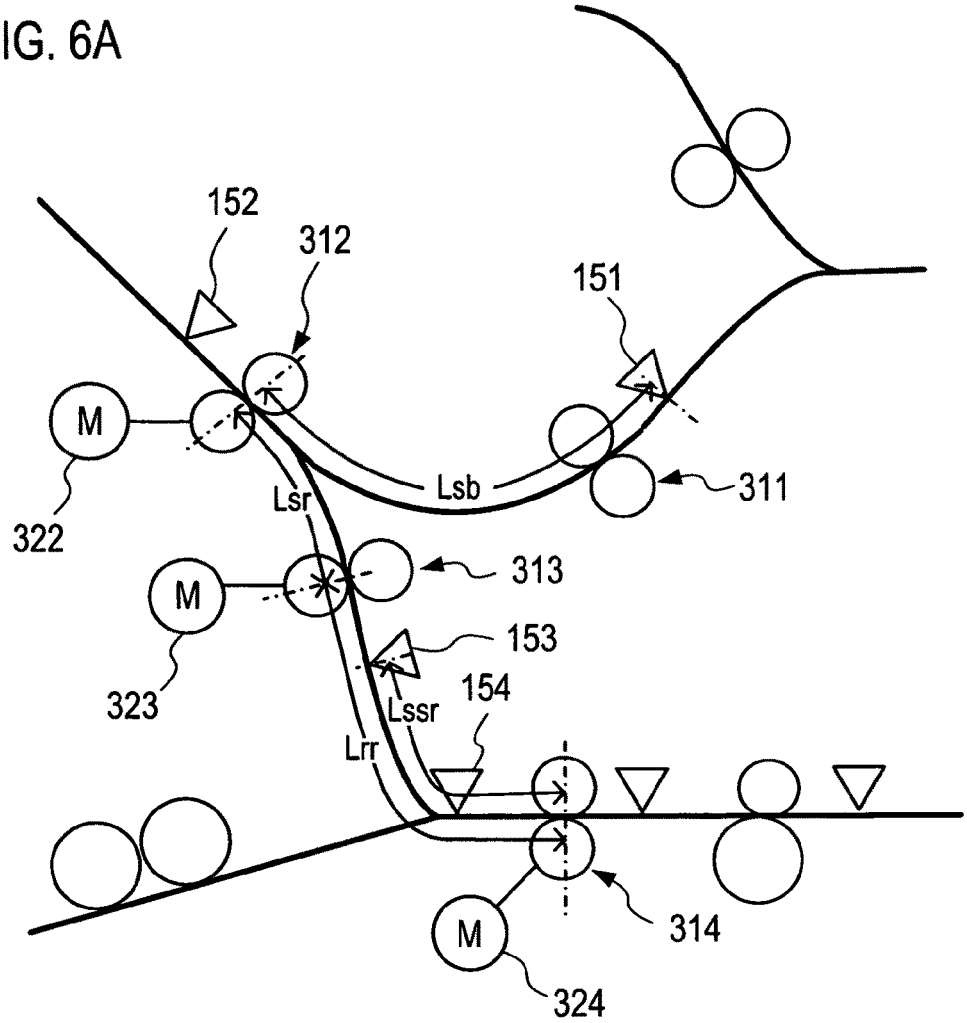
FIGS. 6A to 6C are views for explaining distances to be referred to in this embodiment.
Figure 6B:
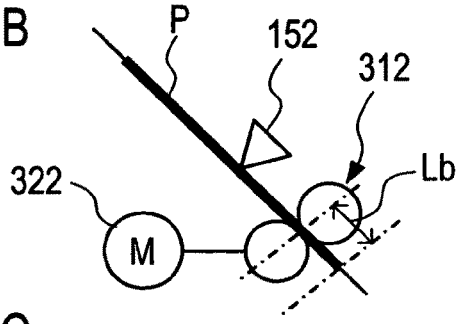
Figure 6C:
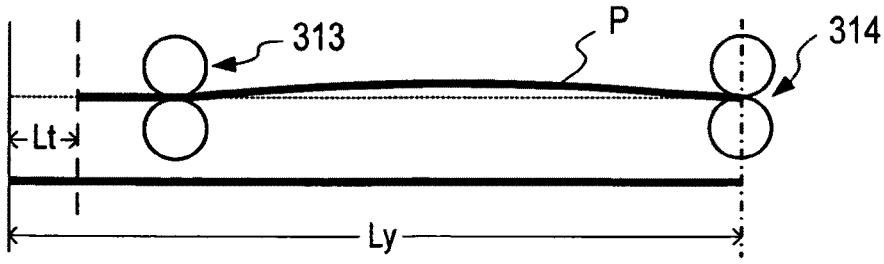

FIGS. 6A to 6C are views for explaining distances to be referred to in this embodiment. As shown in FIG. 6A, a distance from the upper-side transfer exit sensor 151 to the switchback roller 312 along the transfer path is defined as a distance Lsb, a distance from the switchback roller 312 to the sheet refeed roller 313 is defined as a distance Lsr, a distance from the sheet refeed roller 313 to the registration roller 314 is defined as a distance Lrr, and a distance from the sheet refeed roller 153 to the registration roller 314 is defined as a distance Lssr. The distance Lsb, the distance Lsr, the distance Lrr, and the distance Lssr are fixed values to be determined when designing the printer 10.

The switchback roller 312 temporarily stops the print sheet when reversing the print sheet. In this case, as shown in FIG. 6B, the switchback roller 312 stops a print sheet P while leaving a predetermined distance so as to prevent the print sheet P from coming off from the switchback roller 312 and to allow the print sheet P to be transferred toward the sheet refeed roller 313 at the time of the reversing operation. This distance is defined as a distance Lb.

In order to correct inclination of the print sheet P, the registration roller 314 stops the print sheet P while leaving a slack as shown in FIG. 6C. Here, although the transfer path is actually curved, the transfer path is illustrated in FIG. 6C as a straight path for the sake of clarity. Accordingly, the sheet refeed roller 313 transfers the print sheet P beyond the distance to the registration roller in order to provide the slack. This amount of slack is defined as a distance Lt. The distance Lb and the distance Lt may be set to an appropriate amount in advance and may be changed later in response to printing conditions and the like.

Figure 7:
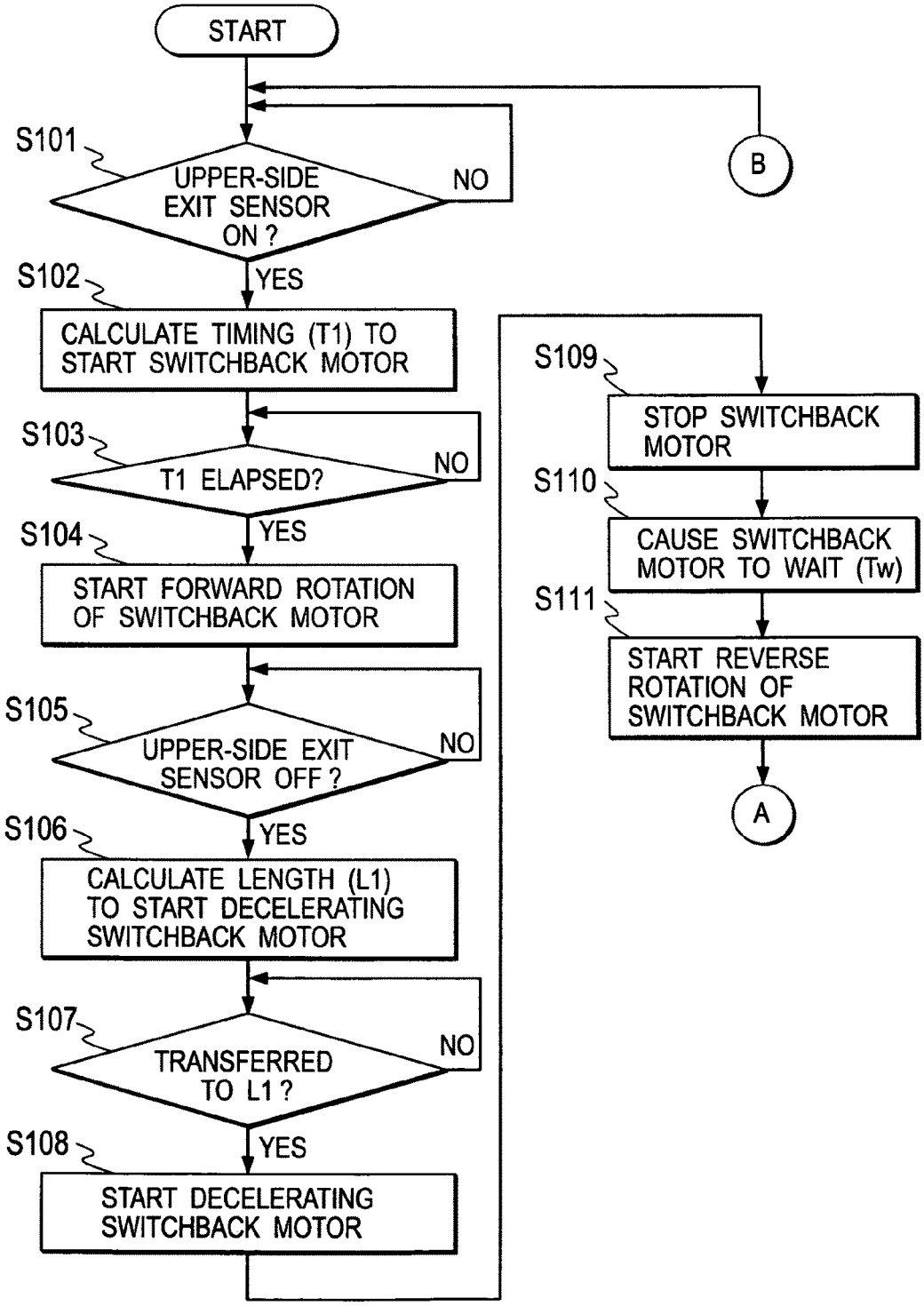
FIG. 7 is a flowchart for explaining a process for controlling a switchback motor which drives a switchback roller.
Figure 8:
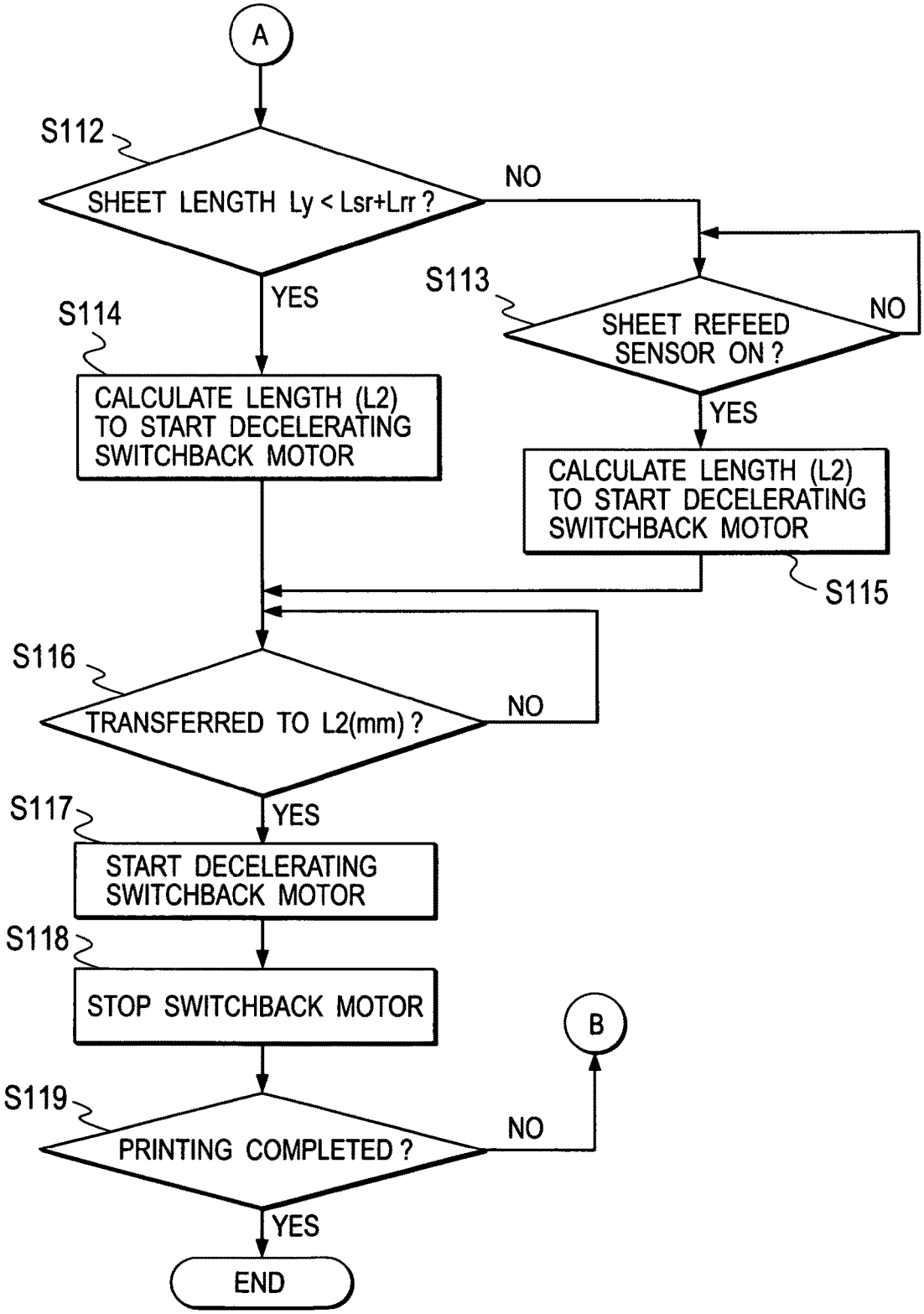
FIG. 8 is another flowchart for explaining the process for controlling the switchback motor which drives the switchback roller.

Next, control processing of the switchback motor 322 configured to drive the switchback roller 312 will be described with reference to flowcharts in FIGS. 7 and 8. In this embodiment, at the time of a forward rotating operation, the switchback roller 312 needs to be rotating at the same speed as the transfer speed Vr of the upper-side transfer exit roller 311 when the print sheet reaches the switchback roller 312 in order to take over the print sheet smoothly from the upper-side transfer exit roller 311. In this case, it is necessary to consider acceleration time until the rollers reach the transfer speed Vr from a stopped state.

On the other hand, at the time of a reversing operation, a state of transferring the print sheet by using both of the switchback roller 312 and the sheet refeed roller 313 will continue after the print sheet is passed to the sheet refeed roller 313 at the transfer speed Vr. Accordingly, it is necessary to maintain the same speed as the sheet refeed roller until the print sheet goes out of the switchback roller 312. Specifically, if only the switchback roller 312 starts deceleration in the state of transferring the print sheet by using both of the switchback roller 312 and the sheet refeed roller 313, the print sheet will be pulled by both of the rollers. As a consequence, a load may be applied either to the print sheet or to the motor that drives any of the rollers. Otherwise, any of the rollers may cause skidding. Moreover, if there is a delay in starting deceleration of the switchback roller 312, there is a risk that the forward rotating operation of a subsequent print sheet is not started in time.

Therefore, the transfer controller 112 of this embodiment is configured to adjust the timing of the switchback motor 322 to start the forward rotating operation so as to correspond to the transfer speed Vr, and is also configured to adjust the timing to start deceleration at the time of the reversing operation so as to correspond to the length Ly of the print sheet, as described below.

When the both side printing is started, the transfer controller 112 stands by until the upper-side transfer exit sensor 151 is turned on (S101). When the upper-side transfer exit sensor 151 detects a front end of the transferred print sheet and outputs an on signal (Yes in S101), the transfer controller 112 calculates a start timing T1 of the switchback motor 322 (S102). The timing T1 is calculated in accordance with Formula 1. Here, the acceleration at the time of starting and stopping the motor is defined as a predetermined value $\alpha$.

$$T1 = \frac{Lsb}{Vr} - \frac{Vr}{\alpha} - Tm \qquad \text{(Formula 1)}$$

Here, the first term on the right side is the time consumed until the print sheet is transferred from the upper-side transfer exit sensor 151 to the switchback roller 312, the second term on the right side is the time necessary for the switchback roller 312 to reach the rotating speed Vr from the stopped state, and the third term on the right side is a predetermined margin. Specifically, the switchback roller 312 has to be started quicker as the transfer speed Vr is faster, and the value T1 therefore becomes a smaller value.

The transfer controller 112 stands by for a lapse of the time T1 after the upper transfer exit sensor 151 is turned on (S103), and after the lapse of the time T1 (Yes in S103), the transfer controller 112 causes the switchback motor 322 to start the forward rotation (S104). In this way, the switchback roller 312 reaches the rotating speed Vr at a time point when the print sheet is transferred to the switchback roller 312 at the transfer speed Vr. Accordingly, the switchback roller 312 can take over the transfer of the print sheet smoothly.

Next, the transfer controller 112 stands by until the upper-side transfer exit sensor 151 is turned off (S105). When the upper-side transfer exit sensor 151 detects a rear end of the transferred print sheet and outputs an off signal (Yes in S105), the transfer controller 112 calculates a deceleration start transfer length L1 of the switchback motor 322 (S106). The value L1 is calculated in accordance with Formula 2.

$$L1 = Lsb - Lb - \frac{Vr^2}{2\alpha} \qquad \text{(Formula 2)}$$

Here, the first term on the right side is the distance between the upper-side transfer exit sensor 151 and the switchback roller 312, the second term on the right side is a remaining length of the rear end of the print sheet in the switchback roller 312, and the third term on the right side is a transfer distance at the time of deceleration.

When the print sheet is transferred to the distance L1 after the upper transfer exit sensor 151 is turned off (Yes in S107), the switchback motor 322 which is operated to perform the forward rotation at the speed Vr starts deceleration (S104). The acceleration in this case is α. Accordingly, the switchback motor 322 is stopped after a lapse of time expressed by Vr/α (S109). Thus, the print sheet is stopped in such a manner that the rear end having the length of Lb is left on the switchback roller 312.

Then, the switchback motor 322 is stopped for a waiting time period (Tw) which is predetermined in order to start the reversing operation (S110). After the lapse of the waiting time period (Tw), the reverse rotating operation of the switchback motor 322 is started (S111). The acceleration in this case is also α. Accordingly, the print sheet is switched back, and when reaching the transfer speed Vr, the print sheet is transferred toward the sheet refeed roller 313 at a constant speed.

Next, before calculating the deceleration start timing of the switchback motor 322, a case analysis is executed depending on the length Ly of the print sheet in the transfer direction (S112). In this embodiment, the case analysis is executed depending on whether or not the length Ly of the print sheet is shorter than the distance Lsr+Lrr from the switchback roller 312 to the registration roller 314 so as not to cause the switchback roller 312 and the sheet refeed roller 313 to transfer the print sheet at mutually different speeds. To be more precise, the case analysis is executed depending on whether or not a length $Ly+Vr^2/2\alpha$ is shorter than the distance Lsr+Lrr while considering the distance $Vr^2/2\alpha$ which is necessary for stopping at the registration roller 314 after starting deceleration. In the following description, the length Ly of the print sheet will be used as a criterion for the purpose of simplification.

When the length Ly of the print sheet is shorter than the distance Lsr+Lrr from the switchback roller 312 to the registration roller 314 (Yes in S112), a deceleration start transfer length L2 of the switchback motor 322 is calculated (S114). The length L2 is calculated in accordance with Formula 3.

$$L2=Ly-Lb \quad \text{(Formula 3)}$$

Since the remaining length at the rear end of the print sheet is Lb in the stopped state, the print sheet will go out of the switchback roller when transferred to the distance of Ly−Lb. When the length Ly of the print sheet is shorter than the distance Lsr+Lrr from the switchback roller 312 to the registration roller 314, the print sheet goes out of the switchback roller 312 before a tip of the print sheet reaches the register roller 314 in a stopped position. Accordingly, by starting deceleration of the switchback motor 322 (S117) after transferring to the distance L2 using the switchback roller 312 (S116: Yes), there is no tension on the print sheet attributable to the difference in the speed between the switchback roller 312 and the sheet refeed roller 313.

On the other hand, when the length Ly of the print sheet is equal to or longer than the distance Lsr+Lrr from the switchback roller 312 to the registration roller 314 (No in S112), the print sheet does not go out of the switchback roller 312 before reaching the registration roller 314. For this reason, the switchback roller 312 has to perform deceleration synchronously with the sheet refeed roller 313 in order to stop the print sheet at the registration roller 314. Accordingly, the transfer controller 112 stands by until the sheet refeed sensor 153 is turned on (S113). When the sheet refeed sensor 153 outputs an on signal (Yes in S113), the transfer controller 112 calculates the deceleration start transfer length L2 of the switchback motor 322 (S115). The length L2 is calculated in accordance with Formula 4.

$$L2 = Lssr + Lt - \frac{Vr^2}{2\alpha} \quad \text{(Formula 4)}$$

Here, the first term on the right side is the distance from the sheet refeed roller 153 to the registration roller 314, the second term on the right side is the slack amount of the sheet at the registration roller 314, and the third term on the right side is the transfer distance at the time of deceleration. By starting deceleration of the switchback motor 322 (S117) after transferring to the distance L2 since an arrival of the tip of the print sheet at the sheet refeed sensor 153 (Yes in S116), the print sheet can be stopped at the registration roller 314. In this case, the sheet refeed motor 323 also starts deceleration at the same timing. Accordingly, there is no tension on the print sheet attributable to the difference in the speed between the switchback roller 312 and the sheet refeed roller 313.

In any case, the switchback motor 322 is stopped after the lapse of the time period Vr/α from the start of deceleration (S118). Thereafter, when printing is not completed (No in S119), the transfer controller 112 stands by until the upper-side transfer exit sensor 151 is turned on by a subsequent sheet (S101) and repeats the procedures thereafter until printing is completed (Yes in S119). In this case, it is possible to apply the same values to the start timing (T1) of the switchback motor 322 and to other parameters. Accordingly, it is not necessary to calculate these values again.

Figure 9:
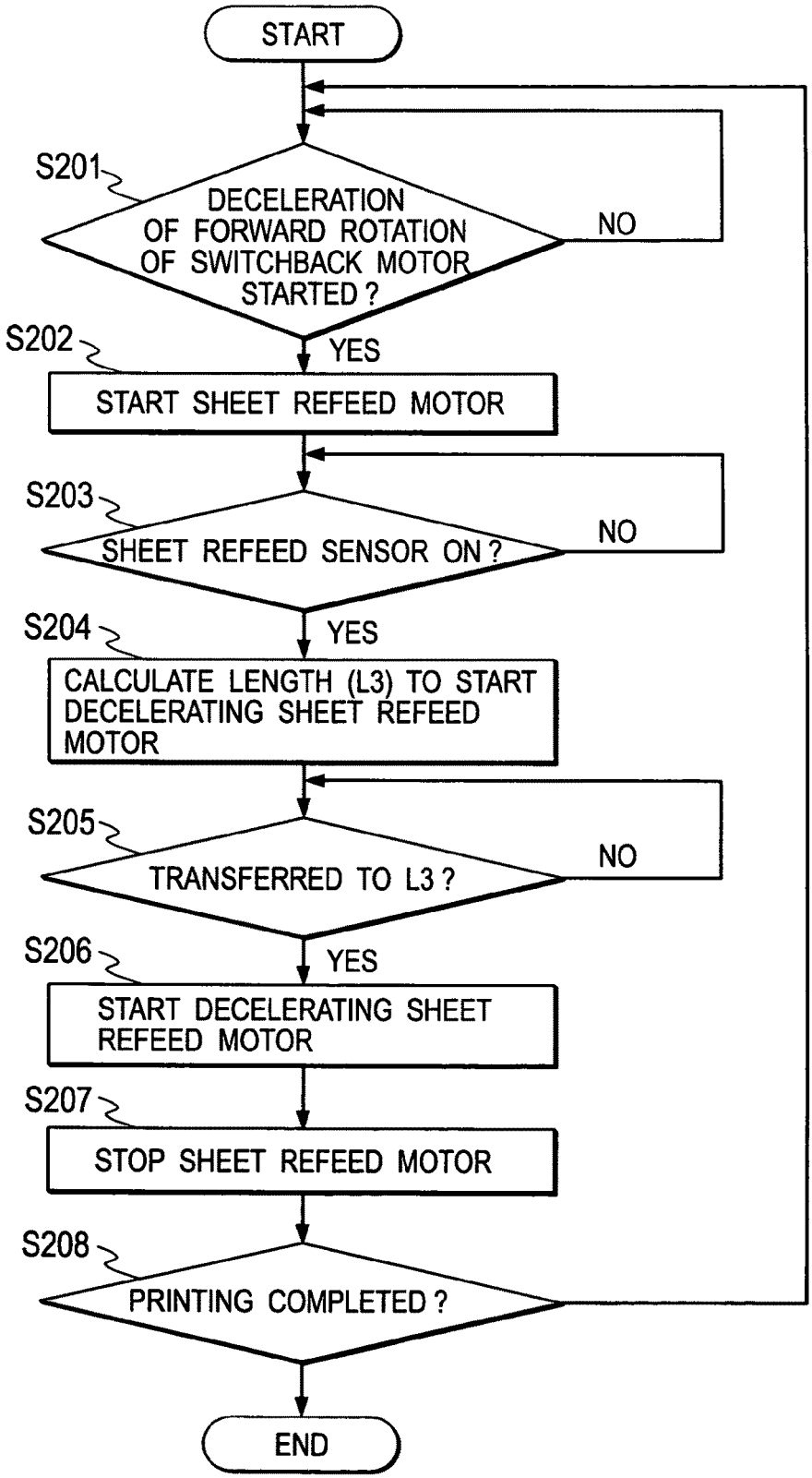
FIG. 9 is a flowchart for explaining a process for controlling a sheet refeed motor which drives a sheet refeed roller.

Next, control processing of the sheet refeed motor 323 configured to drive the sheet refeed roller 313 will be described with reference to a flowchart in FIG. 9.

The sheet refeed motor 323 only needs to achieve the transfer speed Vr at the point of taking over the print sheet from the switchback roller 312 at the time of the reversing operation. The sheet refeed roller 323 does not perform a reverse rotating operation. Therefore, it is not necessary to define a start timing precisely. Here, the sheet refeed motor 323 is started (S202) while using deceleration of the forward rotating operation of the switchback motor 322 as a trigger (Yes in S201).

Then, the transfer controller 112 stands by until the sheet refeed sensor 153 is turned on (S203). When the sheet refeed sensor 153 outputs an on signal (Yes in S203), the transfer controller 112 calculates a deceleration start transfer length L3 of the sheet refeed motor 323 (S204). The length L3 is calculated in accordance with Formula 5 which is similar to Formula 4.

$$L3 = Lssr + Lt - \frac{Vr^2}{2\alpha} \quad \text{(Formula 5)}$$

By starting deceleration of the sheet refeed motor 323 (S206) after transferring to the distance L3 since an arrival of the tip of the print sheet at the sheet refeed sensor 153 (Yes in S205), the sheet refeed motor 323 is stopped after a lapse of the time period Vr/α whereby the tip of the print sheet can be stopped at the registration roller 314.

Thereafter, when printing is not completed (No in S208), the transfer controller 112 stands by until the switchback motor 322 starts deceleration of the forward rotating operation (S201) and repeats the procedures thereafter until printing is completed (Yes in S208). In this case, it is possible to apply the same value to the deceleration start transfer length L3 of the sheet refeed motor 323. Accordingly, it is not necessary to calculate this value again.

Figure 10:
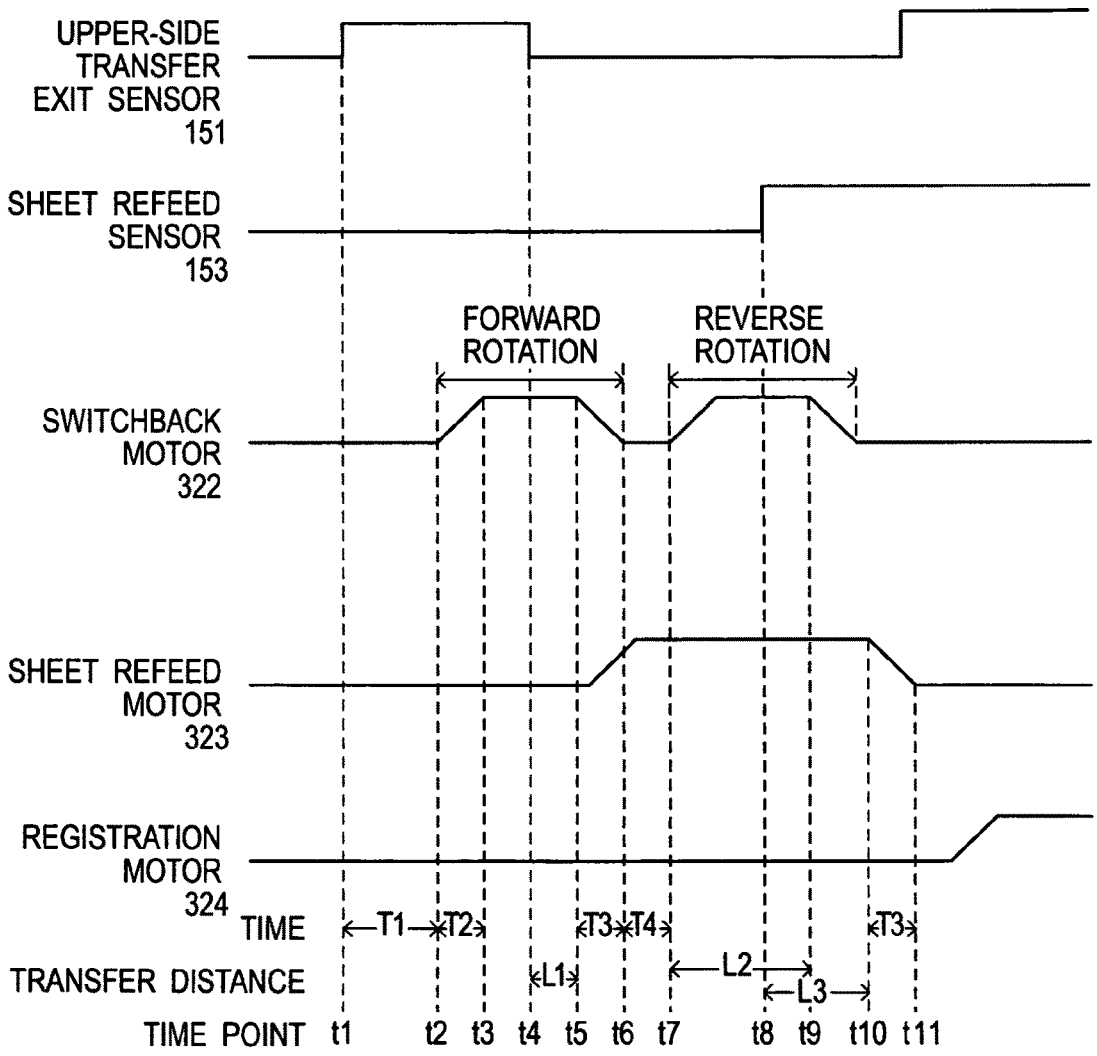
FIG. 10 is a timing chart for explaining the control of the switchback motor and the sheet refeed motor when a length Ly of a print sheet is shorter than a distance Lsr+Lrr from a switchback roller 312 to a registration roller 314.
Figure 11:
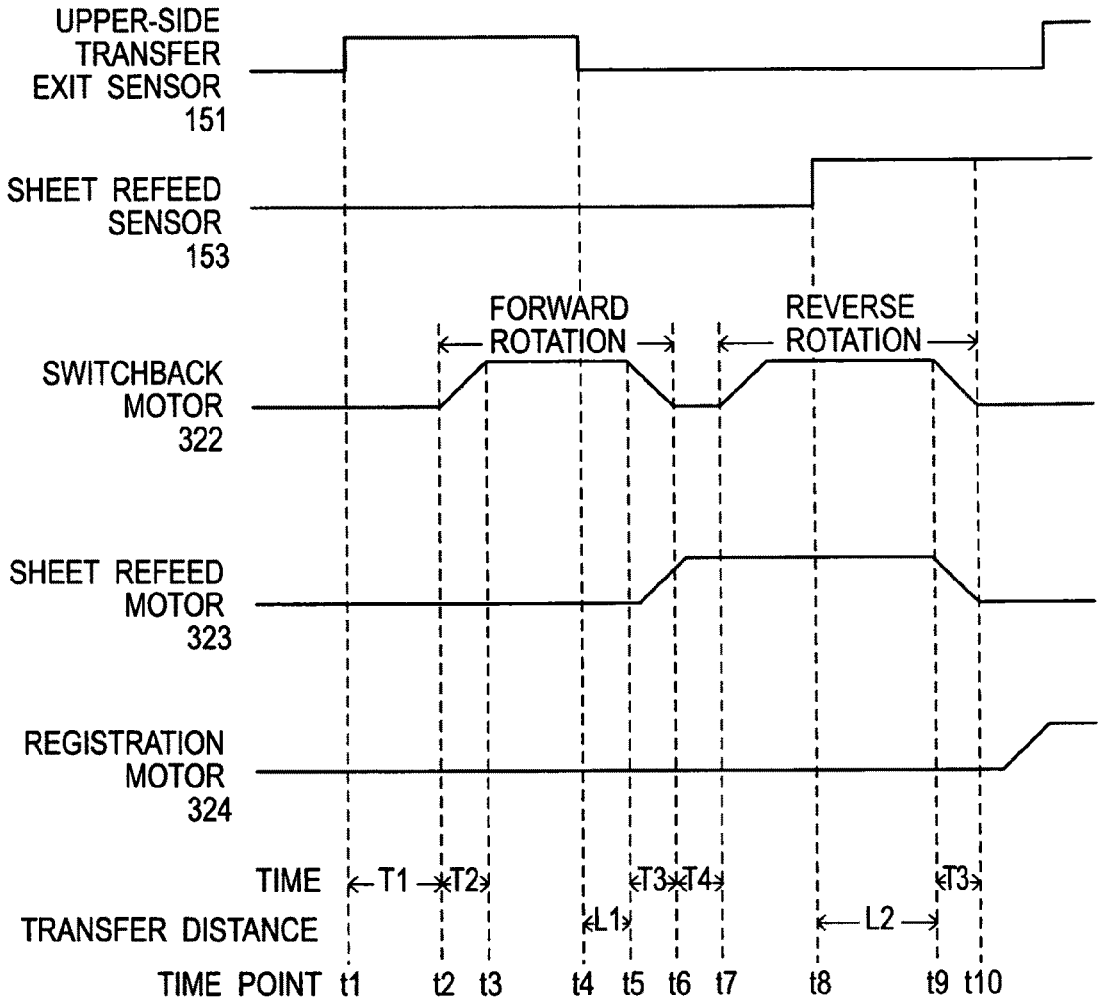
FIG. 11 is a timing chart for explaining the control of the switchback motor and the sheet refeed motor when the length Ly of the print sheet is equal to or longer than the distance Lsr+Lrr from the switchback roller 312 to the registration roller 314.

FIG. 10 and FIG. 11 are timing charts showing the control of the switchback motor 322 and the sheet refeed motor 323. FIG. 10 shows the case when the length Ly of the print sheet is shorter than the distance Lsr+Lrr from the switchback roller 312 to the registration roller 314. Meanwhile, FIG. 11 shows the case when the length Ly of the print sheet is equal to or longer than the distance Lsr+Lrr from the switchback roller 312 to the registration roller 314. Here, as described previously, the length $Ly+Vr^2/2\alpha$ can be used as the criterion of the case analysis instead of the length Ly more precisely. Here, the longitudinal axis in FIG. 10 and FIG. 11 indicates on states and off states in terms of the upper-side transfer exit sensor 151 and the sheet refeed sensor 153, and indicates the rotating speeds in terms of the switchback motor 322, the sheet refeed motor 323, and the registration motor 324.

In any case, when the upper-side transfer exit sensor 151 outputs the on signal at a time point t1, the switchback motor 322 starts the forward rotating operation at a time point t2 after the lapse of the time period T1 calculated in accordance with Formula 1. Then, the speed of the switchback motor 322 reaches the speed Vr at a time point t3 after the lapse of the period $Vr/\alpha$ (=T2) and the speed Vr is maintained thereafter.

When the upper-side transfer exit sensor 151 outputs the off signal at a time point t4, the switchback motor 322 starts deceleration of the forward rotating operation at a time point t5 representing the time after transferring the print sheet to the distance L1 as calculated in accordance with Formula 2. The sheet refeed motor 323 starts rotation almost at the same time, and when the rotation reaches the speed Vr, the sheet refeed motor 323 maintains the speed Vr.

The switchback motor 322 is stopped at a time point t6 after the lapse of the period $Vr/\alpha$ (=T3) since the switchback motor 322 starts deceleration of the forward rotating operation, and the stopped state is maintained for the waiting time period Tw (=T4). Then, the switchback motor 322 starts the reverse rotating operation at a time point t7 after the lapse of the waiting time period Tw (=T4). Thereafter, the switchback motor 322 reaches the speed Vr after the lapse of the period $Vr/\alpha$ and maintains the speed.

When the length Ly of the print sheet is shorter than the distance Lsr+Lrr from the switchback roller 312 to the registration roller 314, the paper sheet goes out of the switchback roller 312 at a time point t9 after transferring the print sheet to the distance L2 calculated in accordance with Formula 3 since the switchback motor 322 starts the reverse rotating operation at the time point t7 as shown in FIG. 10. Accordingly, the switchback motor 322 starts deceleration of the reverse rotating operation at the time point t9. Thereafter, the switchback motor 322 is stopped after the lapse of the period $Vr/\alpha$.

Meanwhile, when the sheet refeed sensor 153 outputs the on signal at a time point t8, the sheet refeed motor 323 starts deceleration at a time point t10 after transferring the print sheet for the distance L3 calculated in accordance with Formula 5. Then, the sheet refeed motor 323 is stopped at a time point t11 after the lapse of the period $Vr/\alpha$ (=T3) whereby the tip of the print sheet is stopped at the registration roller 314.

On the other hand, when the length Ly of the print sheet is equal to or longer than the distance Lsr+Lrr from the switchback roller 312 to the registration roller 314, as the sheet refeed sensor 153 outputs the on signal at the time point t8, both of the switchback motor 322 and the sheet refeed motor 323 start deceleration at the time 9 after transferring the print sheet to the distance L2 calculated in accordance with Formula 4 as shown in FIG. 11. Thereafter, both of the switchback motor 322 and the sheet refeed motor 323 are stopped at the time point t10 after the lapse of the period $Vr/\alpha$ (T3) whereby the tip of the print sheet is stopped at the registration roller 314.

As described above, according to this embodiment, the sheet reversing mechanism can properly perform the forward-reverse control in order to accomplish output of print sheets at a productivity level achievable by a printing mechanism.

An image forming apparatus according to the embodiment of the present invention has been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiment of the present invention are only a list of optimum effects achieved by the present invention. Hence, the effects of the present invention are not limited to those described in the embodiment of the present invention.

What is claimed is:

1. An image forming apparatus comprising:

a circulating transfer path configured to form a path for circulatingly transferring print sheets, the path including a switchback reverse path for reversing print sheets;

a plurality of transfer mechanisms provided on the circulating transfer path and configured to transfer print sheets;

an image forming unit configured to perform image formation on print sheets being transferred on the circulating transfer path;

a sheet reversing mechanism provided on the switchback reverse path, the sheet reversing mechanism configured to take over and transfer, at a transfer speed Vr, a print sheet with an image already formed on one side being transferred at the transfer speed Vr from a first transfer mechanism, to stop the print sheet once, then to start transfer of the print sheet in an opposite direction, and to pass the print sheet to a second transfer mechanism at the transfer speed Vr, the first transfer mechanism being located on an upstream of the switchback reverse path, the second transfer mechanism being located on a downstream of the switchback reverse path;

a print sheet detection unit provided on the upstream of the switchback reverse path and configured to detect presence or absence of a print sheet; and a transfer control unit configured to control the sheet reversing mechanism, wherein upon lapse of a time T1 after detection of the print sheet by the print sheet detection unit, the transfer control unit drives the sheet reversing mechanism to start acceleration from a stopped state to the transfer speed Vr, the time T1 calculated based on the transfer speed Vr, and wherein the time T1 is calculated shorter, as the transfer speed Vr becomes greater.

2. An image forming apparatus comprising:

a circulating transfer path configured to form a path for circulatingly transferring print sheets, the path including a switchback reverse path for reversing print sheets;

a plurality of transfer mechanisms provided on the circulating transfer path and configured to transfer print sheets;

an image forming unit configured to perform image formation on print sheets being transferred on the circulating transfer path;

a sheet reversing mechanism provided on the switchback reverse path, the sheet reversing mechanism configured to take over and transfer, at a transfer speed Vr, a print sheet with an image already formed on one side being transferred at the transfer speed Vr from a first transfer mechanism, to stop the print sheet once, then to start transfer of the print sheet in an opposite direction, and to pass the print sheet to a second transfer mechanism at the transfer speed Vr, the first transfer mechanism being located on an upstream of the switchback reverse path, the second transfer mechanism being located on a downstream of the switchback reverse path;

a print sheet detection unit provided on the upstream of the switchback reverse path and configured to detect presence or absence of a print sheet; and a transfer control unit configured to control the sheet reversing mechanism, wherein upon lapse of a time T1 after detection of the print sheet by the print sheet detection unit, the transfer control unit drives the sheet reversing mechanism to start acceleration from a stopped state to the transfer speed Vr, the time T1 calculated based on the transfer speed Vr; and a registration transfer mechanism provided on the circulating transfer path, the registration transfer mechanism configured to define a reference position of print sheets to be transferred to the image forming unit, wherein the transfer control unit changes a reference for a timing at which the sheet reversing mechanism starts deceleration while transferring the print sheet to the downstream of the switchback reverse path, depending on a relation between a length in a transfer direction of the print sheet and a distance between the sheet reversing mechanism and the registration transfer mechanism on the circulating transfer path.

3. The image forming apparatus according to claim 2, wherein the transfer control unit upon the length in the transfer direction of the print sheet being shorter than the distance between the sheet reversing mechanism and the registration transfer mechanism on the circulating transfer path, starts deceleration of the sheet reversing mechanism at a time point when transfer of the print sheet to the downstream of the switchback reverse path is completed by the sheet reversing mechanism, and upon the length in the transfer direction of the print sheet being equal to or longer than the distance between the sheet reversing mechanism and the registration transfer mechanism on the circulating transfer path, starts deceleration of the sheet reversing mechanism so as to stop the print sheet at the registration transfer mechanism.

4. The image forming apparatus according to claim 2, wherein the transfer control unit upon a sum of the length in the transfer direction of the print sheet and a distance in which the print sheet is transferred before being stopped at the registration transfer mechanism after start of deceleration being shorter than the distance between the sheet reversing mechanism and the registration transfer mechanism on the circulating transfer path, starts deceleration of the sheet reversing mechanism at a time point when transfer of the print sheet to the downstream of the switchback reverse path is completed by the sheet reversing mechanism, and upon the sum of the length in the transfer direction of the print sheet and the distance in which the print sheet is transferred before being stopped at the registration transfer mechanism after start of deceleration being equal to or longer than the distance between the sheet reversing mechanism and the registration transfer mechanism on the circulating transfer path, starts deceleration of the sheet reversing mechanism so as to stop the print sheet at the registration transfer mechanism.

5. The image forming apparatus according to claim 2, wherein the sheet reversing mechanism includes a switchback roller configured to transfer the print sheet being transferred from the upstream of the switchback reverse path and to transfer the print sheet to the downstream of the switchback reverse path, the registration transfer mechanism includes a registration roller configured to transfer the print sheet to the image forming unit, the transfer control unit upon the length in the transfer direction of the print sheet being shorter than a distance between the switchback roller and the registration roller on the circulating transfer path, starts deceleration of the switchback roller at a time point when the print sheet is detached from the switchback roller while being transferred to the downstream of the switchback reverse path, and upon the length in the transfer direction of the print sheet being equal to or longer than the distance between the switchback roller and the registration roller on the circulating transfer path, starts deceleration of the switchback roller so as to stop the print sheet at the registration roller.

6. The image forming apparatus according to claim 2, wherein the sheet reversing mechanism includes a switchback roller configured to transfer the print sheet being transferred from the upstream of the switchback reverse path and to transfer the print sheet to the downstream of the switchback reverse path, the registration transfer mechanism includes a registration roller configured to transfer the print sheet to the image forming unit, the transfer control unit upon a sum of the length in the transfer direction of the print sheet and a distance in which the print sheet is transferred before being stopped at the registration transfer mechanism after start of deceleration being shorter than a distance between the switchback roller and the registration roller on the circulating transfer path, starts deceleration of the switchback roller at a time point when the print sheet is detached from the switchback roller while being transferred to the downstream of the switchback reverse path, and upon the sum of the length in the transfer direction of the print sheet and the distance in which the print sheet is transferred before being stopped at the registration transfer mechanism after start of deceleration being equal to or longer than the distance between the switchback roller and the registration roller on the circulating transfer path, starts deceleration of the switchback roller so as to stop the print sheet at the registration roller.

7. An image forming apparatus comprising:

a circulating transfer path configured to form a path for circulatingly transferring print sheets, the path including a switchback reverse path for reversing print sheets;

a plurality of transfer mechanisms provided on the circulating transfer path and configured to transfer print sheets;

an image forming unit configured to perform image formation on print sheets being transferred on the circulating transfer path;

a sheet reversing mechanism provided on the switchback reverse path, the sheet reversing mechanism configured to take over and transfer, at a transfer speed Vr, a print sheet with an image already formed on one side being transferred at the transfer speed Vr from a first transfer mechanism, to stop the print sheet once, then to start transfer of the print sheet in an opposite direction, and to pass the print sheet to a second transfer mechanism at the transfer speed Vr, the first transfer mechanism being located on an upstream of the switchback reverse path, the second transfer mechanism being located on a downstream of the switchback reverse path;

a print sheet detection unit provided on the upstream of the switchback reverse path and configured to detect presence or absence of a print sheet; and a transfer control unit configured to control the sheet reversing mechanism, wherein upon lapse of a time T1 after detection of the print sheet by the print sheet detection unit, the transfer control unit drives the sheet reversing mechanism to start acceleration from a stopped state to the transfer speed Vr, the time T1 calculated based on the transfer speed Vr, and wherein the image forming unit performs image formation on print sheets each having a length Ly in a transfer direction while employing a sheet interval Lg and a transfer speed Vg at a time of printing, and the transfer speed Vr is set such that the print sheet is transferred circulatingly from the registration transfer mechanism to the same registration transfer mechanism within a time period of $N\times(Ly+Lg)/Vg$, wherein N is a circulating number to define a printing order for both side printing.

* * * * *